United States Patent [19]

Albers et al.

[11] 4,056,517

[45] Nov. 1, 1977

[54] MODACRYL FILAMENTS AND FIBERS AND PROCESS FOR THEIR MANUFACTURE

[75] Inventors: Ernst-August Albers, Bad Soden, Taunus; Bernd Sassenrath, Niedernhausen, both of Germany

[73] Assignee: Hoechst Aktiengesellschaft, Frankfurt am Main, Germany

[21] Appl. No.: 661,117

[22] Filed: Feb. 25, 1976

Related U.S. Application Data

[63] Continuation of Ser. No. 318,269, Dec. 26, 1972, abandoned.

[30] Foreign Application Priority Data

Dec. 28, 1971 Germany ..... 2164918

[51] Int. Cl.[2] ..... C08F 28/00

[52] U.S. Cl. ..... 260/79.3 M; 264/182; 264/210 F; 526/342

[58] Field of Search ..... 264/182, 210 F; 526/342; 260/79.3 M

[56] References Cited

U.S. PATENT DOCUMENTS

| | | | |
|---|---|---|---|
| 3,682,800 | 8/1972 | Miyama et al. | 204/159.23 |
| 3,729,531 | 4/1973 | Suling et al. | 264/211 |
| 3,732,339 | 5/1973 | Suling et al. | 264/211 |
| 3,943,223 | 3/1976 | Kozuka et al. | 264/182 |

FOREIGN PATENT DOCUMENTS

| | | | |
|---|---|---|---|
| 42-13747 | 8/1967 | Japan | 264/182 |
| 45-2770 | 1/1970 | Japan | 264/182 |
| 47-34441 | 11/1972 | Japan | 264/182 |
| 47-38463 | 9/1972 | Japan | 264/182 |

*Primary Examiner*—Jay H. Woo

*Attorney, Agent, or Firm*—Curtis, Morris & Safford

[57] ABSTRACT

The invention relates to modacryl filaments and fibers made from copolymers insoluble in acetone of acrylonitrile and from 20 to 45 weight % of vinylidene chloride, containing from 0 to 1.5 weight % of unsaturated organic sulfonic acids or the salts thereof, and from 0 to 10 weight % of further copolymerizable compounds, which copolymers have a K value according to Fikentscher of more than about 95 and a process for the manufacture thereof. These modacryl filaments and fibers are especially distinguished by their permanent brilliance and permanent transparence; these properties are maintained even on contact with water having a temperature above 80° C.

5 Claims, No Drawings

MODACRYL FILAMENTS AND FIBERS AND PROCESS FOR THEIR MANUFACTURE

This is a continuation of application Ser. No. 318,269 filed Dec. 26, 1972, now abandoned.

The present invention relates to modacryl filaments and fibers remaining brilliant and transparent on contact with water having a temperature of more than 80° C, made from high molecular weight copolymers that are insoluble in acetone, which copolymers are obtained by copolymerization of acrylonitrile and from 20 to 45 weight % of vinylidene chloride, and, optionally, up to 1.5 weight % of unsaturated organic sulfonic acids, and, optionally, up to 10% of other usual comonomers, and which copolymers have K values according to Fikentscher of more than about 95; and a process for the manufacture of such filaments and fibers. Such modacryl filaments and fibers can be obtained by wet spinning using three or more coagulation baths each having reduced contents of polymer solvent, the spinning tows obtained being drawn in at least one of these baths to a multiple of their length, and the practically solvent-free tows being subjected to at least one further drawing.

By modacryl filaments and fibers, according to the rules of the Federal Trade Commission of the U.S.A., there are to be understood those filaments and fibers the fiber-forming substance of which is a polymer containing less than 85 weight %, but more than 35 weight % of acrylonitrile.

In known processes, there are obtained modacryl filaments and fibers from copolymers of acrylonitrile and vinylidene chloride in the weight ratio as indicated which filaments and fibers, though being free from cavities visible under the microscope, have the drawback of becoming opaque in hot, especially boiling, water. By becoming opaque there is to be understood the phenomenon of filaments or fibers losing their brilliance on account of diffuse light dispersion due to the formation of cavities in the fiber on contact with hot water. These pores have diameters near the wave length range of visible light. Filaments and fibers made from the cited polymers which are manufactured according to the present invention are stable to boiling and free from cavities. By "stable to boiling", there are to be understood those filaments and fibers remaining brilliant and transparent on contact with hot, especially boiling water.

It is known to spin acrylonitrile/vinylidene chloride copolymers in a wet spinning process, for example from solutions in dimethyl formamide. The modacryl filaments and fibers so obtained, as compared to corresponding material made from polyacrylonitrile, have flame retarding properties, but on contact with water having a higher temperature than 80° C they lose their brilliance and become dull and non-transparent. This dullness may be removed by heating in dry air of more than 100° C or by treatment with concentrated salt solutions. But on renewed contact with hot water, this dullness reappears. Therefore, filaments and fibers not being stable to boiling require special safety measures, especially when they are dyed in aqueous baths at elevated temperature (cf., R. K. Kennedy in ManMade Fibers, Vol. 3 (1968), p. 227).

As a consequence of this lack of stability to boiling, non-brilliant dyeings are obtained, and in order to obtain the same color intensity more dyestuff is required than in the case of filaments or fibers being stable to boiling. Moreover, the fastness to light of dyeings on opaque material is reduced. Therefore, the brilliancy and the transparence of the filaments or fibers must be restored by an appropriate after-treatment, which means not only an additional operation and thus more expenditure, but also the risk of uneven dyeings, since the dullness cannot be uniformly removed. A later renewed contact of these materials with hot water may again result in opaqueness and alteration of the color intensity.

According to British Pat. No. 1 102 576 it is known to prepare filaments and fibers stable to boiling from copolymers of acrylonitrile and vinylidene chloride in acetone by wet spinning from solutions in acetone. Copolymers having less than 45 weight % of vinylidene chloride and the filaments and fibers manufactured therefrom are insoluble in acetone. In the process as described in the cited patent, filaments and fibers containing many large cavities are obtained, and therefore they cannot be used for a number of textile applications. The stability to boiling of these textile materials can only be achieved by a storage of the spun filaments in water of several days in most cases, and a subsequent drawing.

It has now been found that filaments and fibers made from acrylonitrile/vinylidene chloride copolymers insoluble in acetone, containing from 20 to 45 weight % of vinylidene chloride and up to 11.5 weight % of further copolymerizable compounds can be obtained by dissolving these copolymers having K values according to Fikentscher (definition cf. Cellulosechemic 13, 58 (1932) of more than about 95, in usual solvents for acrylonitrile polymers, for example dimethyl formamide, dimethyl acetamide, dimethyl sulfoxide or ethylene carbonate, and spinning this polymer solution in a special wet spinning process. This process comprises the use of several, at least three, coagulation baths having gradually reduced contents of polymer solvent, a drawing of the filaments to a multiple of their length in at least one of these baths, and at least one further drawing of the practically solvent-free filaments.

Optimum results have been attained when processing co-polymers having a K value of from about 100 to 120. If copolymers having K values below 95 are used, the instability to boiling increases progressively with decreasing K values.

Suitable materials for the filaments and fibers stable to boiling in accordance with the present invention are acetone-soluble copolymers of acrylonitrile and from 20 to 45 weight % of vinylidene chloride, containing optionally, in order to improve the dyestuff affinity, also up to 1.5 weight % of an unsaturated organic sulfonic acid, for example vinylsulfonic, allylsulfonic, methallylsulfonic, styrenesulfonic acid, or the salts thereof, and, optionally, up to 10 weight % of one or more further copolymerizable monomers, for example acrylic, methacrylic, or α-chloro-acrylic acid; acrylic acid esters, such as methyl acrylate, ethyl acrylate, butyl acrylate methoxy-methyl acrylate, α-chloro-ethyl acrylate, or corresponding esters of methacrylic and α-chloro-acrylic acid; methacrylic acid nitrile, acrylamide, methacrylamide or α-chloro-acrylamide or the N-alkyl or N,N-dialkyl derivatives thereof; vinyl carboxylates, such as vinyl acetate, vinyl propionate, vinyl stearate, trichloro-acetic acid vinyl ester; phosphonic acids, such as vinylphosphonic acid, allylphosphonic acid and the esters and salts thereof; tertiary amines, such as 2-vinylpyridine, 4-vinylpyridine,2-methyl-5-vinylpyridine, vinylpiperidine, 2-dimethyl-amino-ethyl-methacrylate; unsaturated dicarboxylic acids and the derivatives thereof, such as maleic or citraconic acid; maleic acid ester, N-alkyl- or N-aryl-maleic imides, styrene, vinylnapnthalene, vinyl chloride, vinyl bromide, vinyl fluoride, vinylidene fluoride, vinylidene bromide, 1-chloro-1-bromo-ethylene and other monoolefinically unsaturated copolymerizable monomers. The copolymers may be prepared in any known manner, for example by discontinuous or continuous emulsion or suspension polymerization.

In order to improve the dyestuff affinity of acrylonitrile/ vinylidene chloride copolymer filaments or fibers, monomers are additionally used in the copolymerization which cause more steric hindrance than the nitrile group, and/or monomers which contain acidic or basic groups in the molecule.

The spinning solutions are for example prepared as follows: the pulverulent copolymer is suspended at a temperature below 5° C in dimethyl formamide and dissolved with agitation at room temperature; if necessary, the solution is heated. Advantageously, the polymer concentration is determined in such a way as to impart to the spinning solution a viscosity of from 100 to 500 poise at the desired spinning temperature. These spinning solutions may contain also stabilizers, optical brighteners, dyestuffs or dulling agents.

The homogeneous spinning solution so obtained for example, is degased in a suitable manner and then forced through a spinning nozzle into a first coagulation bath, which has a temperature of from 0° to 70° C, preferably from 20° to 40° C, and contains a mixture of a solvent and a non-solvent for the polymer. The tow thus spun is introduced into a second coagulation bath at a temperature in the same range as the first bath and containing also a mixture of solvent and non-solvent for the polymer. The content of polymer solvent in the first coagulation bath exceeds that of the second coagulation bath by about 1.2 to 2.0 times, preferably 1.4 to 1.8 times.

As non-solvent for the polymer, all those compounds or mixtures of compounds miscible with the polymer solvent used may be employed which, at higher concentration, cause precipitation of the polymer, for example water, aliphatic alcohols, such as methanol, ethanol, isopropanol, tertiary butanol; polyhydric alcohols, such as ethyleneglycol, glycerol; aromatic hydrocarbons, halogenated hydrocabons, caboxylic acid esters, ethers, polyglycols etc.

The composition of the coagulation baths depends on the nature of the solvent and non-solvent and on the desired coagulation speed; the first bath may contain for example, from 50 to 70 weight % of dimethyl formamido in water or from 30 to 50 weight % of dimaethyl formamide in methanol. The tows spun are generally drawn from the coagulation bath at a speed less than the speed of the spinning solution emerging from the nozzle. After having left the second spinning bath, the tow is passed on to a third coagulation bath having a temperature of from 20° to 90° C, preferably from 40° C to 80° C, and a content of solvent reduced by a factor of from 1.2 to 3 as compared to that of the second coagulation bath. The tow may then be conveyed to further coagulation baths having the same temperature as the third bath, the polymer solvent concentration of which, however, is reduced by a factor of from 1.2 to 3 in each case. In at least one of these baths, the tow is drawn to a total 2- to 6-fold its original length. Subsequently, the solvent, content of the filament is reduced to 0.2 weight % by thorough washing, and the filament is then subjected to a further drawing to a 1.1 - to 2-fold its length. This second drawing can be carried out in a hot non-solvent, hot steam, hot air, on a flat iron or by means of heatable godets; optionally this drawing may be done in several steps.

The spinning tows so obtained are after-treated as usual, for example by application of a suitable finish and a subsequent drying. By setting the filaments, preferably with free shrinkage, the textile properties are improved. In the case where staple fibers are manufactured, the latter process steps may be carried out before or after the spinning tows are cut.

The stability to boiling is examined by two different methods. First a comparison is carried out by a microscopic 120-fold magnification of samples boiled in water and dried at 60° C with untreated samples. In the case of filaments or fibers being stable to boiling, there is no difference before and after boiling; in the case of products not stable to boiling, the filaments or fibers treated with boiling water look grey to black in transmitted light.

Second, the remission power at 4200 of samples is compared, which samples are dyed for two hours at boiling temperature with 5% of Remacryl Blue RL (C.I. Basic Blue 22); one sample being dried at 60° C and the other at 125° C. Those fibers and filaments in the respect to which difference in the remission power does not exceed 3% are considered stable to boiling. In the case of products not being stable to boiling, the sample dried at 125° C has less remission power than that dried at 60° C, since the opaqueness of the material is removed by the drying at 125° C, while remission power is maintained when the material is dried at 60° C.

The following examples illustrate the invention. All percentages indicated are by weight.

EXAMPLE 1:

15 parts of a copolymer of 60% of acrylonitrile and 40% of vinylidene chloride having a K value of 102, prepared by suspension-percipitation polymerization, are dissolved in 85 parts of dimethyl formamide.

This spinning solution is spun through a nozzle having 100 holes of a diameter of 70 μm at a rate of 3.3 $cm^3$/min. into a first coagulation bath having a length of 60 cm, containing a mixture of 65% of dimethyl formamide and 35% of water having a temperature of 25° C. Without an intermediate conveying device, the spinning tow obtained is passed on to a second coagulation bath having also a length of 60 cm, containing 40% of dimethyl formamide and 60% of water at a temperature of also 25° C. The spinning tow is then drawn off the second coagulation bath by means of a draw-off roller at a speed of 4m/min., passed on to a third bath containing 20% of dimethyl formamide and 80% of water of a temperature of 60° C, drawn three times its length washed with water of 90° C, dried and finallly drawn two times its length at 120° C on a pair of rollers. The filament so obtained is steamed for 15 minutes in steam of 110° C with free shrinkage, and it then has the following properties:

| | |
|---|---|
| titer | 240 dtex |
| tensile strength | 3.5 g/dtex |
| elongation at break | 20 % |

The filaments obtained have a very good degree of whiteness, high brilliancy and complete transparence.

At a 120-fold magnification under the microscope, a material boiled in water for 1 hour shows no difference as compared to an unboiled material. Both samples are transparent and free from cavities. A product dyed with Remacryl Blue RL at boiling temperature and dried at 60° C has a remission power at 4200 of 37.2 %, a product dried at 125° C of 37.4% under these conditions. The filaments obtained are therefore stable to boiling.

COMPARATIVE EXAMPLE A

A spinning solution according to Example 1 is spun under the same conditions into a coagulation bath containing 65% of dimethyl formamide and 35 % of water, but after 20 cm of immersion in the bath it is drawn off this coagulation bath and drawn in a drawing bath containing also 65 % of dimethyl formamide and 35 % of water. All further conditions are as in Example 1. The filaments obtained (the monocapillaries partially stuck together) have the following properties:

| | |
|---|---|
| titer | 240 dtex |
| tensile strength | 3.0 g/dtex |
| elongation at break | 23 % |

The filaments obtained are transparent and brilliant; at a 120-fold magnification under the microscope, no cavities are observed. On boiling water, these filaments however become dull and opaque. Under the microscope, a filament so treated looks black in transmitted light. Samples dyed with Remacryl Blue RL and dried at 60° C and 125° C give the following remission values:

| | |
|---|---|
| dried at 60° C | 41.0 % |
| dried at 125° C | 37.3 % |

The filaments obtained thus are not stable to boiling.

COMPARATIVE EXAMPLE B

23 Parts of a copolymer of 40% of vinylidene chloride and 60% of acrylonitrile having a K value of 86, prepared by suspension-precipitation polymerization, are dissolved in 77 parts of dimethyl formamide, and this solution is spun as indicated in Example 1. Filaments having the following properties are obtained:

| | |
|---|---|
| titer | 365 dtex |
| tensile strength | 1.3 g/dtex |
| elongation at break | 17 % |

The filaments are transparent and brilliant, but become opaque and loose their brilliancy on boiling water.

At 120-fold magnification under the microscope, filaments untouched by hot water have no cavities and pores. Filaments treated in boiling water, however, look black in transmitted light under the microscope. As to the remission power of samples dyed with Remacryl Blue RL and dried at different temperature the following data are obtained:

| | |
|---|---|
| 60° C dried | 41.4 % |
| 125° C dried | 35.2 % |

EXAMPLE 2

A copolymer of 75% of acrylonitrile and 20% of vinylidene chloride and 5% of acrylic acid methyl ester having a K value of 106 dissolved in dimethyl formamide to form a 14% spinning solution, which is spun as indicated in Example 1. The filaments obtained are brilliant, transparent, pore-free, have a very good degree of whiteness and the following properties:

| | |
|---|---|
| titer | 218 dtex |
| tensile strength | 3.4 g/dtex |
| elongation at break | 19 % |
| Remission value of samples dyed with Remacryl Blue RL: | |
| 60° C dried | 36.8 % |
| 125° C dried | 36.8 % |

EXAMPLE 3

A spinning solution according to Example 1 is spun through a nozzle having 60 holes of a diameter of 80 μm at a rate of 9 $cm^3$/min. into a first coagulation bath having a length of 80 cm, and containing 35% of dimethyl formamide and 65% of methanol at a temperature of 40° C. The filaments obtained are conveyed to a second spinning bath having a length of 40 cm and containing 25% of dimethyl formamide and 75% of methanol at a temperature of 40° C. The filaments are drawn off the second coagulation bath over a draw-off roller at a speed of 5m/min. and conveyed to a third coagulation bath containing 15% of dimethyl formamide and 85% of methanol at a temperature of also 40° C. The spinning tow is drawn in this bath to a 4.8-fold of its original length and, after having passed over further conveyors, washed water of 90° C, again drawn to a 1.25-fold of its length also in water of 90° C, dried and a third time drawn over a flat iron having a temperature of 140° C for a further 6.5%.

After steaming (15 minutes at 110° C), brilliant, transparent, pore-free filaments stable to boiling and having the following properties are obtained:

| | |
|---|---|
| titer | 950 tex |
| tensile strength | 2.6 g/dtex |
| elongation at break | 25 % |
| Remission values of samples dyed with Remacryl Blue RL: | |
| 60° C dried | 28.6 % |
| 125° C dried | 28.3 % |

EXAMPLE 4

16 Parts of a copolymer composed of 69% of acrylonitrile, 25% of vinylidene chloride, 5.0 % of methacrylic acid methyl ester and 1% of sodium methallylsulfonate having a K value of 100, prepared by suspension - precipitation polymerization are dissolved in 84 pars of dimethyl formamide; and the spinning solution obtained is spun according to Example 1. The filaments obtained have the following properties:

| | |
|---|---|
| titer | 260 dtex |
| tensile strength | 3.2 g/dtex |
| elongation at break | 22 % |
| Remission values of samples dyed with Remacryl Blue RL: | |
| 60° C dried | 37.9 % |
| 125° C dried | 38.1 % |

What is claimed is:

1. A process for the manufacture of modacryl filaments and fibers from an acetone-insoluble copolymer of acrylonitrile, 20 to 45 weight percent of vinylidene chloride and up to 11.5 weight percent of at least one other compound copolymerizable therewith, said copolymer having a K value of about 95 to 120, which comprises dissolving said copolymer in a solvent to form a spinning solution, forcing the spinning solution so obtained through nozzles into the first of at least three series-connected coagulation baths containing mixtures of the polymer solvent and at least one nonsolvent for the polymer, the polymer solvent concentration in the first coagulation bath being from 30% to 70% by weight of said bath and being gradually reduced in successive coagulation baths, the polymer solvent concentration in the first coagulation bath being about 1.2 to 2.0 times that of the second coagulation bath, the polymer solvent concentration in each coagulation bath subsequent to the second bath being reduced by a factor of 1.2 to 3 in each such subsequent bath, the temperatures of the first and second coagulation baths being from 0° to 70° C., those of the third and the following baths being from 20° to 90° C., drawing the spinning tows obtained to a multiple of their length in at least one of these baths and, after removal of the solvent as completely as possible, subjecting said drawn tows to at least one further drawing.

2. A process according to claim 1 wherein a total of three coagulation baths are employed.

3. A process according to claim 1 wherein dimethyl formamide is used as the polymer solvent and water as nonsolvent.

4. A process according to claim 1 wherin dimethyl formamide is used as polymer solvent and methanol as nonsolvent.

5. Modacryl filaments and fibers that retain their luster in contact with water at a temperature above 80° C., said filaments being made by the process of claim 1 from an acetoneinsoluble copolymer of acrylonitrile, 20 to 45 weight percent of vinylidene chloride, 0 to 1.5 weight percent of unsaturated organic sulfonic acid or salt thereof and from 0 to 10 weight percent of one or more other copolymerizable compound, said copolymer having a K value of 95 to 120.

* * * * *